US008349268B2

(12) United States Patent
Yeung

(10) Patent No.: US 8,349,268 B2
(45) Date of Patent: Jan. 8, 2013

(54) PYROLYSIS OF RESIDUAL HYDROCARBONS

(75) Inventor: Columba Yeung, Calgary (CA)

(73) Assignee: Value Creation Inc., Calgary, Alberta (CA)

( * ) Notice: Subject to any disclaimer, the term of this patent is extended or adjusted under 35 U.S.C. 154(b) by 0 days.

(21) Appl. No.: 13/247,006

(22) Filed: Sep. 28, 2011

(65) Prior Publication Data

US 2012/0048713 A1 Mar. 1, 2012

Related U.S. Application Data

(62) Division of application No. 11/383,137, filed on May 12, 2006, now Pat. No. 8,057,662.

(51) Int. Cl.

| | |
|---|---|
| ***B01J 8/08*** | (2006.01) |
| ***C10G 9/04*** | (2006.01) |
| ***C10G 9/28*** | (2006.01) |

(52) U.S. Cl. ..... 422/213; 422/209; 422/214; 422/215; 208/126

(58) Field of Classification Search ..... 422/209, 422/211, 213–215; 208/125, 126, 130
See application file for complete search history.

(56) References Cited

U.S. PATENT DOCUMENTS

| | | | | |
|---|---|---|---|---|
| 2,664,389 | A | 1/1949 | Rex et al. | |
| 3,481,720 | A | 12/1969 | Bennett | |
| 4,180,455 | A | 12/1979 | Taciuk | |
| 4,306,961 | A | 12/1981 | Taciuk | |
| 4,324,642 | A | 4/1982 | Durai-Swamy | |
| 4,411,769 | A | 10/1983 | Oldweiler | |
| 4,446,004 | A | 5/1984 | Chen et al. | |
| 4,477,331 | A | 10/1984 | Reed et al. | |
| 4,563,246 | A * | 1/1986 | Reed et al. | 202/100 |
| 4,583,468 | A | 4/1986 | Reed et al. | |
| 4,724,777 | A | 2/1988 | Reed et al. | |
| 5,039,395 | A | 8/1991 | Martin et al. | |
| 5,423,891 | A | 6/1995 | Taylor | |
| 5,607,577 | A * | 3/1997 | Koszarycz et al. | 208/391 |
| 6,183,627 | B1 | 2/2001 | Friday et al. | |
| 6,187,172 | B1 | 2/2001 | Plummer | |
| 6,203,765 | B1 | 3/2001 | Taciuk et al. | |
| 6,365,038 | B1 | 4/2002 | Doron | |
| 6,589,417 | B2 | 7/2003 | Taciuk et al. | |
| 7,138,047 | B2 | 11/2006 | Stell et al. | |
| 2004/0004022 | A1 * | 1/2004 | Stell et al. | 208/106 |
| 2004/0069686 | A1 * | 4/2004 | Freel et al. | 208/226 |

FOREIGN PATENT DOCUMENTS

| | | |
|---|---|---|
| CA | 1121749 | 4/1982 |
| CA | 2314586 | 11/2006 |
| RU | 2066338 | 9/1996 |
| SU | 435262 | 11/1974 |

* cited by examiner

*Primary Examiner* — Walter D Griffin
*Assistant Examiner* — Renee E Robinson
(74) *Attorney, Agent, or Firm* — Bennett Jones LLP

(57) ABSTRACT

A process and apparatus for upgrading heavy hydrocarbons such as asphaltenes to lighter oil and gas components is disclosed. The process provides a reaction environment that promotes fast and selective cracking of heavy hydrocarbons, while minimizing coke formation and fouling and enhancing product yields.

13 Claims, 2 Drawing Sheets

PYROLYSIS OF RESIDUAL HYDROCARBONS

CROSS REFERENCE TO RELATED APPLICATIONS

This application is a divisional application of U.S. patent application Ser. No. 11/383,137 filed on May 12, 2006, entitled "Pyrolysis of Residual Hydrocarbons", the contents of which are incorporated herein by reference.

FIELD OF THE INVENTION

The present invention relates to a pyrolytic method and apparatus for upgrading residual hydrocarbons, and asphaltenic hydrocarbons in particular.

BACKGROUND OF THE INVENTION

Upgrading of heavy oil refers to any process of fractionation or treatment of bitumen to increase its value. About one-half of bitumen can be recovered by atmospheric and vacuum distillations, leaving heavy residual hydrocarbons with contaminants. These residual hydrocarbons and other heavy hydrocarbons from various sources can be cracked to give smaller molecules which are more valuable products.

Conventional upgrading technologies include catalytic cracking and thermal cracking or pyrolysis. Catalytic cracking of residual hydrocarbons, particularly asphaltenic hydrocarbons, is difficult as large molecular weight hydrocarbons have low diffusivity into catalyst pores and channels. As well, residual hydrocarbons are rich in coke precursors and catalyst poisons, which severely restrict effective utilization of catalysts. As a result, catalytic methods are less common, and pyrolytic methods are more commonplace in residue upgrading.

Thermal cracking is the oldest and, in a way, the simplest cracking process. It basically aims at the reduction of molecular size by application of heat without any additional sophistication such as catalyst or hydrogen. At temperature levels exceeding about 370° C., the larger hydrocarbon molecules become unstable and tend to break into smaller molecules. By varying the reaction time, temperature and pressure under which a particular feedstock remains under cracking conditions, the desired degree of cracking (conversion) can be controlled.

Coking is a widely-implemented form of thermal cracking, where light products are formed together with significant amounts of coke. Coking, like all pyrolytic methods, is an endothermic process and it is well known that the rate of reaction increases rapidly with increased temperature. However, because coke formation and fouling of heat transfer surfaces also increase rapidly with temperature, viable operating temperatures are conventionally limited to a lower range. Therefore, reaction rates and effectiveness of conventional pyrolytic methods, such as thermal cracking and coking processes are limited.

Additionally, the rate of heating affects coke production. If a feedstock is gradually heated to a pyrolytic temperature, coke formation is significantly higher than if the feedstock is rapidly brought to the same temperature. In U.S. Pat. No. 3,481,720 issued to Bennett on Dec. 2, 1969, a method of pyrolysis of oil shale or oil sands in a concentric reactor-combustor unit is disclosed. Hot "spent" oil shale or oil sands is combined with cold feed oil shale or oil sands to recover heat energy and preheat the feedstock. With oil shale or oil sands, a significant amount of energy is required to heat the shale or sands to reaction temperatures; therefore, heat exchange between the hot "spent" shale or sands with the cold feedstock is essential for energy economy. However, such gradual heating of the feedstock drastically increases coke formation and fouling when processing residual hydrocarbon feedstock, and would be impractical for asphaltenes or residues with high asphaltene contents.

Therefore, there is a need in the art for a process that can achieve fast and selective pyrolysis of heavy hydrocarbons, with high yields of valuable light oils and gases, while significantly reducing coke formation and fouling that constrain conventional pyrolysis.

SUMMARY OF THE INVENTION

The present invention provides a process of pyrolysis of heavy hydrocarbons that provides relatively fast and selective upgrading into light oils and gases. The process may operate at higher temperatures than conventional pyrolytic processes, without significant adverse coke formation and fouling. The process of this invention operates at temperatures typically about 100° to 300° C. higher than conventional coking processes, preferably in the range of 500° to 800° C., and more preferably greater than 650° C., in the front end of the reactor. As a result, in one preferred embodiment, the intrinsic reaction rates of the present invention may be about 2 orders of magnitude higher than conventional pyrolysis processes, with lower coke make and sustainable operation without severe fouling.

Therefore, in one embodiment, the invention comprises a method of pyrolytic upgrading of hydrocarbons, comprising the steps of:

(a) flash cracking a hydrocarbon feedstock in a reaction zone with particulate solids heated to a temperature at least about 500° C., producing vapour products and coke, with typically a coke:CCR ratio of about 1.0 or less;
(b) removing vapour products from the reaction zone;
(c) transporting the solids from the reaction zone to a combustion zone where the solids are heated by combustion of accumulated coke;
(d) transporting heated solids from the combustion zone to the reaction zone;
(e) recovering the vapour products.

In another aspect, the invention comprises an apparatus for pyrolysis of heavy hydrocarbons comprising:

(a) a reaction chamber having a feed inlet and a vapour outlet;
(b) a combustion chamber;
(c) a thermal mass comprising particulate solids disposed within the reaction chamber and the combustion chamber;
(d) transfer means for transporting heated solids from the combustion chamber to the reaction chamber and recycling solids from the reaction chamber back to the combustion chamber;
(e) vapour recovery means connected to the vapour outlet.

In one embodiment, the reaction chamber and combustion chamber are horizontally disposed in a single cylindrical vessel.

BRIEF DESCRIPTION OF THE DRAWINGS

The invention will now be described by way of an exemplary embodiment with reference to the accompanying simplified, diagrammatic, not-to-scale drawings where.

DESCRIPTION OF THE INVENTION

One embodiment of the invention will now be described, with reference to the schematic process flow schemes shown in FIG. 1 and FIG. 2. In the following description, undefined terms have the meaning commonly recognized by those skilled in the art. The process and apparatus described herein are used to upgrade hydrocarbons, and heavy hydrocarbons in particular, including residual hydrocarbons and asphaltenes. The feedstock for the present invention may comprise any hydrocarbon which forms valuable products if upgraded or cracked.

Figure 1:
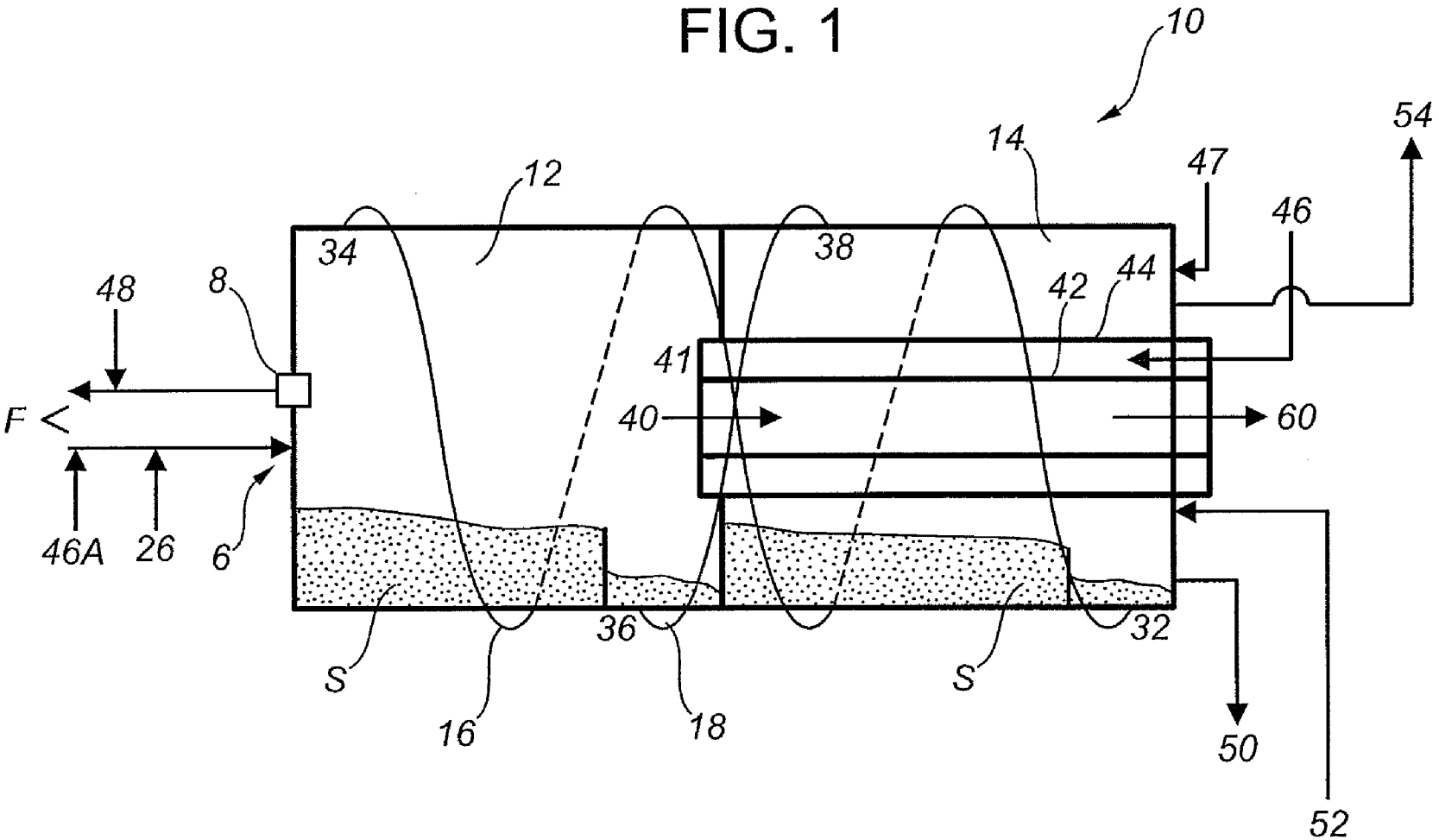
FIG. 1 is a schematic representation of a reactor/combustor vessel of the present invention and FIG. 2 is a schematic representation of a quench tower of the present invention.

As shown in FIG. 1, the primary process unit or vessel (10) comprises a reaction chamber or reactor (12) and a combustion chamber or combustor (14). In principle, it is possible to use separate reaction and combustion vessels, or one vessel with reaction and combustion zones and the present invention includes all such alternatives within its scope. In a preferred embodiment, the invention comprises a single vessel with separate and horizontally disposed reaction (12) and combustion (14) chambers.

Figure 2:
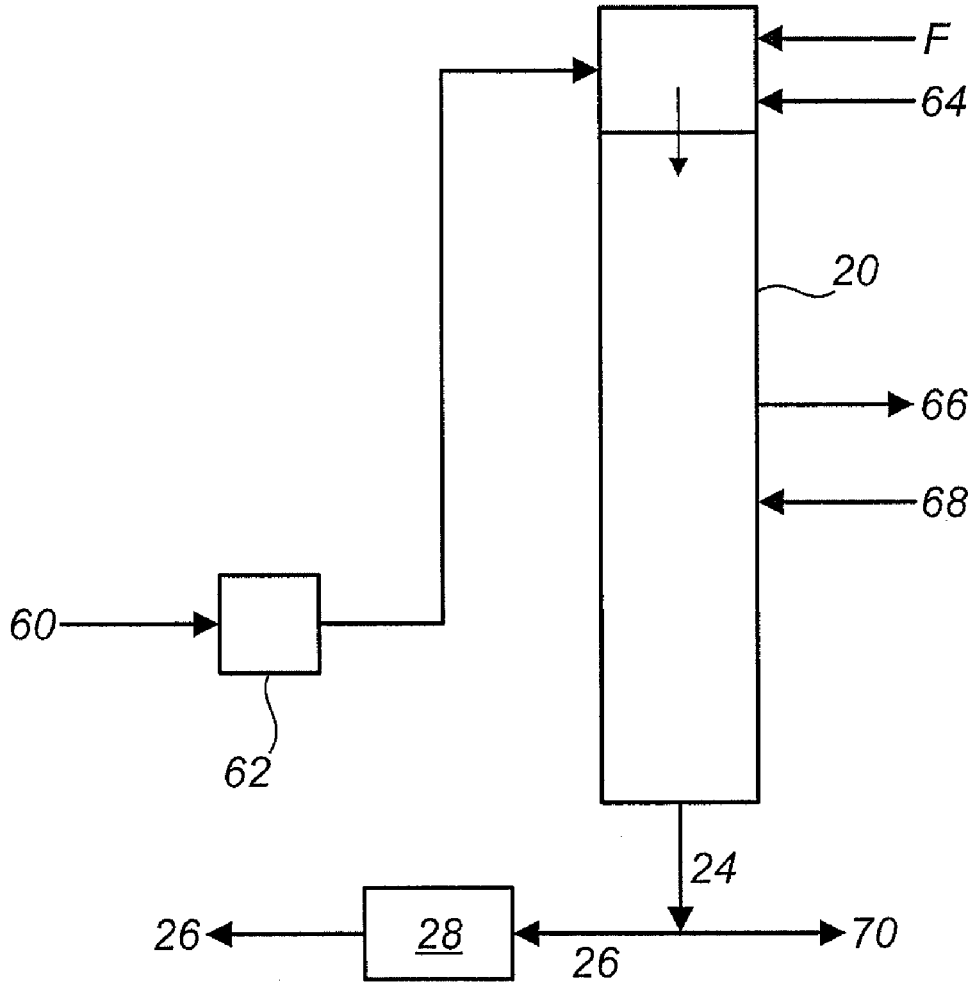

A secondary process unit or quench tower (20) may be used to quench the produced hot vapour products, as shown in FIG. 2. The hot vapour may be quenched with incoming liquid feed (F), which also serves to flash the feed before it enters the reactor (12).

The reactor (12) and the combustor (14) each comprise a bed of heated solid particles (S). In one embodiment, as the vessel rotates, internal lifters (not shown) attached to the vessel wall in both the reactor (12) and the combustor (14) lift the solid particles from the beds and subsequently dump back the particles as the lifters rise above the beds. As will be described below, flow of solids from the reactor (12) to the combustor (14) and back to the reactor (12) is a feature of the present invention. In one embodiment, the two chambers are substantially horizontally disposed and cylindrical. The vessel (10) is rotatable to effect solid flow from one chamber to the other using helical transfer coils (16, 18). In an alternative embodiment, the chambers can be stacked vertically with solid flow achieved by mechanical means, or a combination of mechanical means and gravitation flow. The chambers may also be contained in separate vessels, and solid flow achieved by mechanical means.

The feed (F) may comprise hydrocarbons in either liquid or solid form. In either case, the feed is fed into the reactor (12) to directly contact the solid particles (S) by either an injection sprayer (6), or a solids transfer device (8), or both.

When processing liquid hydrocarbons, the feed is sprayed into the reactor bed in the front end. Preferably, the feed spray should avoid the hot reactor wall. The liquid droplets should be small enough to improve even distribution over the hot solids, but not atomized to avoid entrainment by the vapour product produced within the reactor. In one embodiment, feed temperature should be maintained below 400° C., preferably below 300° C. for asphaltenic residue, until the feedstock exits the feed injection sprayer(s).

The liquid feedstock can be routed directly to the reactor (12), or it can be first fed to the quench tower (20), where it is flashed by contact with hot vapour products. The flashed heavy bottoms (24) can then be routed to the reactor (12) via stream (26), with an optional particulate clean up process (28), where solid contaminants may be removed using conventional or novel methods.

When solid asphaltene particles are used as feedstock, the feedstock can be transported pneumatically, for example by using recycled light hydrocarbon gas products, or mechanically. Preferably, the temperature of the particulate asphaltene feedstock is maintained below its softening point, which is feedstock dependent. Accordingly, in one preferred embodiment, the asphaltene feedstock is maintained below about 100° C. until it exits the transfer device (8). Most solid asphaltene feedstock will not soften significantly below 100° C. If the asphaltene feed melts, it forms an extremely viscous liquid, which may lead to very rapid coking. An asphaltene feedstock will melt if it is gradually heated to reaction temperature.

In one preferred embodiment, the asphaltene feed comprises porous asphaltene aggregates with occluded moisture, which shatter on entry to the hot reaction zone, forming fine particles leading to fast reactions and lower formation of coke.

The bed (S) of hot solid particles is used to provide the heat necessary to drive the endothermic cracking in the reaction zone. Solid bed levels are maintained to effect sufficient hot solid circulation for heat supply from the combustion zone (14) to the reaction zone (12) to sustain the cracking reactions, while maintaining a vapour headspace within the reactor. In one embodiment, the hot solid particles are transferred by means of a helical coil or coils (16), as shown schematically in FIG. 1. As is apparent, when the vessel is rotated about its longitudinal axis, material within the coil will be transported from the outlet end (32) of the combustor in the combustion chamber to the inlet end (34) in the reactor (12). At the same time, transfer line (18) coils in the direction to transport materials from the reactor (12) to the combustor (14). In this manner, solids heated in the combustion chamber are transferred to the reaction chamber, and are returned to the combustion chamber, driven by rotation of the vessel (10).

Additionally, it is possible to transfer hot solids from the outlet end of the combustor (14) to the inlet end of the combustor (14) by means of a separate coil or coils (not shown), to raise the temperature at the combustor inlet end, if necessary or desired.

In one embodiment, solids enter outlet (32) at the end of the combustion chamber (14) near the flue gas exit, and enters the reaction chamber (12) at inlet (34) disposed close to the feedstock inlet. Solids leave the reaction chamber (12) through outlet (36) disposed at the opposite end of the reaction chamber to inlet (34), and enters the combustion chamber (14), at the end (38) opposite the outlet (32). Although one set of coils (16, 18) is illustrated in FIG. 1, a plurality of coils may be used, which may increase operational smoothness.

On exit from the transfer device (8) in the case of solids, or upon injection into the reaction chamber (12) in the case of liquids, the feed comes into direct contact with the very hot solids, rises rapidly in temperature and cracks thermally. It is desirable that the solid temperature is high enough to ensure very fast vaporization of the heaviest desirable products.

Therefore, the hot solids may be in the range of 500° to 800° C. upon entry into the reaction chamber. Preferably, the hot solids are above about 650° C., at the entry of the reactor chamber. Fast vaporization of primary cracked products reduces close contact of reactive intermediates, thereby reducing coke formation by condensation reactions of such reactive intermediates. This fast cracking and vaporization is referred to herein as "flash cracking".

Upon vaporization, the products in gas phase in the reactor (12) are no longer in close contact with the hot solids. This, together with the much lower gas phase residence time ($\tau_G$), vs solid residence time ($\tau_s$), result in lower secondary cracking and hence lower gas make and high liquid yield. The unconverted heavy hydrocarbons stay with and continue to be heated by the hot solids (S), which continues to drive endothermic pyrolysis, and continue to thermally crack with a residence time ($\tau_s$) much higher than ($\tau_G$).

Within the reactor (12), the hot solids (S) move away from the feed inlet end towards the vapour outlet end. The solid movement, in the reactor (12) or combustor (14), can be effected by controlling the angle of repose of the solid bed, and enhanced if desired by inclining the reaction-combustion vessel (10), or by internal means to positively move the bed forward towards the outlet end, such as by auguring plates or angled lifters (not shown).

With flash cracking conditions described above, with gas residence time lower than solid residence time, coke make may be lower than conventional coking. For conventional delayed coker processes, coke/CCR (Conradson Carbon Residue) ratio is usually 1.2 to 1.8. With implementation of the present invention, coke/CCR ratio may be significantly lower, less than about 1.0, and may be in the range of about 0.5 to 0.8. Therefore, it is a feature of the present invention that the coke/CCR ratio does not exceed about 1.0 and is preferably below about 0.8.

Any coke that is formed is predominantly deposited on the hot solids forming the thermal mass. The coked solids exit the reaction zone (36) and transported via the helical coil (18) or other means to the combustion zone (38), where the coke is combusted to generate energy required for the process. Feedstock and vapour products which contact the vessel wall may result in coke deposits on the walls. One feature of the present invention is a self-cleaning mechanism. Coke deposited on the reactor wall is continuously scoured by the solids within the vessel as the vessel rotates.

The hydrocarbon vapour stream (40), comprising the cracked products, exits the reaction zone through a pipe (42), which is preferably routed through the combustion zone (14). As a result, the central pipe (42) walls could be very hot and coking might occur on the internal surfaces of the pipe (42). To minimize vapour coking on very hot pipe wall, it is preferable to provide an insulating gap between the pipe (42) and the combustion zone (14). An insulating gap may be formed by wrapping the pipe (42) in a concentric pipe jacket (44), forming an annular space there between. In one embodiment, steam may be injected through the annular gap. The steam enters from line (46), exits the outer pipe, and enters the reaction zone at (41), mixes with vapour products in the reactor and then enters the inner pipe (42) together with the hot vapour products. The steam insulates the pipe (42) from very high temperatures in the combustion zone. As it enters the vapour pipe (42), the steam accelerates gas velocity within the vapour pipe (42), reducing coking/fouling inside the pipe (42).

Additionally, in a preferred embodiment, the steam becomes super-heated on its way through the outer jacket and promotes steam cracking of the vapour products in the reaction zone and in the exit pipe (42).

In an alternative embodiment, the insulation can be achieved by flowing combustion air through the concentric pipe jacket (44) instead of steam, and directing the combustion air into the combustor (14). In this embodiment, the concentric pipe jacket does not open into the reactor (12); instead, the air is directed into the inlet end of the combustor (14). Steam may be injected by alternate means (46A) into the reactor, if desired or necessary.

In one embodiment, a counter-current operating mode implemented, where the vaporized products exit at the feed inlet end of the reactor, assisted if desired by steam injection. This mode of operation may provide higher liquid yield, but with higher liquid density.

The thermal mass comprising hot solid particles (S) serves to provide a large surface area for rapid heat transfer to the feedstock. Additionally, the thermal mass serves as a heat carrier to deliver heat from the combustion zone to the reaction zone, and directly to the feedstock by contact. In a preferred embodiment, the circulating hot solids comprise limestone particles. In addition to serving as a heat carrier, the limestone will continuously scour coke from the hot wall surfaces without damaging wall surfaces. The limestone is calcined in the combustion zone forming CaO, which assists in removing sour gases. Limestone makeup, with or without lime addition for enhanced sour gas removal, can be injected into the combustion zone (47) or reaction zone (48). The limestone particles may be less than about 10 cm in size, and preferably less than about 1 cm. The smaller the particle size, the greater the surface area presented to the feedstock. However, if the particle size is too small, the particles may become entrained in the gas phase of the reactor and carried out with the flue gas.

Inorganic fines and some coke fines can be carried out by the flue gas and removed by cyclones or other suitable means. Inorganics are also deposited on the hot solid carrier, and the level can be controlled by spent solid removal (50) with solids makeup (47, 48) at a controlled rate.

The coked solids entering the combustor (14) at inlet (38) may be burnt in the presence of air (52), which is preferably preheated. In one embodiment, the air is directed through the concentric pipe jacket (44) to the front end of the combustor (14). Coke burning is well known to those skilled in the art. The coke combustion rate is a function of temperature, oxygen concentration and coke surface area exposed to oxygen. The extent of combustion depends on exposure time of coked surfaces to oxygen.

In a solid bed, only the bed surface exposed to air is active in combustion. Fluidized coke bed with upward air flow is commonly used in combustion, which is rather restrictive in particle size control. In one embodiment of this invention, enhancement of exposure of the coked surfaces to air is achieved by mechanically lifting the hot solids from the solid bed by lifters, and dumping the hot solids in a controlled fashion as the lifters move out of the bed and rise upwards. The solid surface areas of the particles in flight and the flight or exposure times can be precisely calculated and controlled, leading to controllable combustion rate. Depending on coke make, complete or partial oxidation can be desirable. With partial combustion, the flue gas (54) can be routed to a CO-boiler or furnace (not shown).

For mechanical design purposes, the reaction and combustion zones are practically at atmospheric pressure. It may be preferable to maintain the reaction zone pressure at slightly below external pressure to avoid hydrocarbon vapour leakage, as a safety consideration.

TABLE 1

Illustrative Yields of Asphaltene conversion

| Feedstock | Natural Asphaltenes from US Midwest | Asphaltenes produced from Alberta Oil Sands Bitumen |
|---|---|---|
| Form | fine powder | aggregates |
| $C_5$ asphaltene | 70+% w | 80+% w |

TABLE 1-continued

| Illustrative Yields of Asphaltene conversion | | |
|---|---|---|
| Feedstock | Natural Asphaltenes from US Midwest | Asphaltenes produced from Alberta Oil Sands Bitumen |
| YIELDS | | |
| $C_1$-$C_3$ | 13.6% w | 12.6% w |
| $C_4$+ oil | 78.1% v | 77.3% v (36.6 API) |
| Coke | 23.8% w | 29.6% w |

Having described specific embodiments of the invention, it will be apparent to those skilled in the art, various modifications, adaptations and variations of the foregoing specific disclosure can be made without departing from the scope of the invention claimed herein.

What is claimed is:

1. An apparatus for pyrolysis of heavy hydrocarbons comprising:

(a) a combustion chamber;

(b) a reaction chamber in line with and separate from the combustion chamber, the reaction chamber having a feed inlet and a vapour outlet passing through the combustion chamber wherein the feed inlet and the vapor outlet are at opposite ends of the reaction chamber;

(c) transfer means for transporting heat carrier solids from the combustion chamber to the reaction chamber and recycling heat carrier solids from the reaction chamber back to the combustion chamber;

(d) vapour recovery means connected to the vapour outlet.

2. The apparatus of claim 1 wherein the reaction chamber and the combustion chamber are disposed within a single vessel.

3. The apparatus of claim 2 wherein the vessel is substantially cylindrical and rotatable about a substantially horizontal or slightly inclined axis.

4. The apparatus of claim 3 wherein the solids transfer means comprises at least one helical coil having a longitudinal axis substantially aligned with the longitudinal axis of the vessel, wherein rotation of the vessel causes movement of solids within the coil.

5. The apparatus of claim 1 wherein further comprising thermal insulation means for insulating the vapour outlet from the combustion chamber.

6. The apparatus of claim 5 wherein the thermal insulation means comprises a sleeve surrounding the vapour outlet and forming an annular insulating gap between the sleeve and the vapour outlet.

7. The apparatus of claim 6 further comprising steam injection means associated with the insulating gap which has a steam outlet into the reaction zone.

8. The apparatus of claim 5 further comprising air injection means associated with the insulating gap which has an air outlet into the front end of the combustion zone where coked solids enter.

9. The apparatus of claim 1 further comprising means for tumbling the particulate solids in one or both of the reaction chamber and the combustion chamber.

10. The apparatus of claim 9 wherein the tumbling means comprises internal paddle lifters.

11. The apparatus of claim 1 further comprising a quench tower for quenching the Vapour product stream, the quench tower having a gas product outlet and a bottom end liquids outlet.

12. The apparatus of claim 11 wherein the quench tower further comprises means for flashing the feedstock with the vapour product.

13. An apparatus for pyrolysis of heavy hydrocarbons comprising:

(a) a combustion chamber;

(b) a reaction chamber having a feed inlet and a vapour outlet passing through the combustion chamber, and thermal insulation means for insulating the vapour outlet from the combustion chamber;

(c) transfer means for transporting heat carrier solids from the combustion chamber to the reaction chamber and recycling heat carrier solids from the reaction chamber back to the combustion chamber; and (d) vapour recovery means connected to the vapour outlet.

* * * * *